US008784129B2

(12) United States Patent
Ogasawara et al.

(10) Patent No.: US 8,784,129 B2
(45) Date of Patent: Jul. 22, 2014

(54) ELECTRIC CABLE CONNECTING CONSTRUCTION AND ELECTRIC CABLE CONNECTING METHOD

(71) Applicants: Yazaki Corporation, Tokyo (JP); Toyota Jidosha Kabushiki Kaisha, Toyota (JP)

(72) Inventors: Shigeyuki Ogasawara, Kakegawa (JP); Takao Syouji, Kakegawa (JP); Akito Toyama, Kosai (JP); Shinichi Yanagihara, Kakegawa (JP); Michio Ota, Kakegawa (JP); Takenori Tsuchiya, Toyota (JP)

(73) Assignees: Yazaki Corporation, Tokyo (JP); Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/749,886

(22) Filed: Jan. 25, 2013

(65) Prior Publication Data

US 2013/0196533 A1 Aug. 1, 2013

(30) Foreign Application Priority Data

Jan. 27, 2012 (JP) ..... 2012-015292

(51) Int. Cl.
*H01R 11/00* (2006.01)

(52) U.S. Cl.
USPC ..... 439/504

(58) Field of Classification Search
USPC ..... 439/504, 577, 366, 110, 822, 835, 874, 439/875, 883–884, 212–213, 241, 217, 765, 439/754, 500, 627
See application file for complete search history.

(56) References Cited

U.S. PATENT DOCUMENTS 4,126,367 A * 11/1978 Miller ..... 439/504
7,160,157 B1 * 1/2007 Jones et al. ..... 439/883
7,192,319 B1 * 3/2007 Rahman et al. ..... 439/766

FOREIGN PATENT DOCUMENTS

JP 2004362997 A 12/2004

* cited by examiner

*Primary Examiner* — Edwin A. Leon
(74) *Attorney, Agent, or Firm* — Sughrue Mion, PLLC

(57) ABSTRACT

Attaching work of a high-voltage cable is improved. In an electric cable connecting construction of battery packs, the high-voltage cable is connected to conductors held in resin busbar modules for connection with the general electrodes by fastening crimp terminals to the conductors. Two ribs are formed on each of the busbar modules where the crimp terminal is held therebetween to limit an entrained rotation of the crimp terminal. A difference between a gap of the two ribs on one of the adjacent battery packs and a width of the crimp terminal connected to the general electrode is set to a first gap dimension L3 and A difference between a gap and a width of the crimp terminal connected to the general electrode of the other of the adjacent battery packs is set to a second gap dimension L6 larger than the first gap dimension.

3 Claims, 3 Drawing Sheets

ELECTRIC CABLE CONNECTING CONSTRUCTION AND ELECTRIC CABLE CONNECTING METHOD

BACKGROUND OF THE INVENTION

The present invention relates to an electric cable connecting construction and an electric cable connecting method.

Patent Literature 1 discloses a technique which utilizes battery packs each containing a plurality of batteries connected in series as a power supply in an electric vehicle or a hybrid vehicle. These vehicle battery packs are disposed so as to be spaced apart from each other, and general electrodes of adjacent battery packs are connected in series or in parallel by a high-voltage cable.

A resin busbar module is mounted in each battery pack. This busbar module holds a plurality of first conductors which each connect a positive electrode with a negative electrode of adjacent batteries and second conductors which are connected to general electrodes of batteries which are disposed at ends of the battery pack. A number of electric wires which are connected to the batteries in the battery pack and high-voltage cables which are connected to the second conductors are laid out in this busbar module.

Crimp terminals each having a mounting hole formed therein are attached to both ends of the high-voltage cable. For example, the general electrodes that penetrate the corresponding second conductors of the busbar modules to project therefrom are inserted through the mounting holes in the crimp terminal, and nuts are screwed on the general electrodes to thereby allow the crimp terminals at both the ends of the high-voltage cable to be pressed against the second electrodes, whereby the crimp terminals and the general electrodes are electrically connected together. Two ribs are formed on the busbar module in a position where the crimp terminal is held by the two ribs so formed therebetween so as to limit the entrained rotation of the crimp terminal within a certain range when the nut is tightened.

Patent Literature 1 JP-A-2004-362997

Incidentally, when the crimp terminals at both the ends of the high-voltage cable are connected to the general electrodes of the adjacent battery packs, one of the crimp terminals is connected to the general electrode of one of the battery packs and the other crimp terminal is connected to the general electrode of the other battery pack with the high-voltage cable curved.

In a high-voltage cable of this type, however, a sectional area defined in a direction which is at right angles to an axial direction is relatively large relative to an axial length (hereinafter, referred to simply as a length) (for example, a sectional area of 12 sq relative to a length of 200 mm). Therefore, it is not easy to attach the other crimp terminal to a predetermined position of the other battery pack with the high-voltage cable curved.

SUMMARY

Then, a problem that the invention is to solve is how to improve the easy performance of attaching work of a high-voltage cable.

According to one aspect of the embodiments of the present invention, there is provided an electric cable connecting construction in which a plurality of battery packs each including a plurality of batteries connected to each other in series are disposed so as to be space apart from each other and general electrodes of the battery packs which lie adjacent are connected to each other by a high-voltage cable having crimp terminals at ends thereof, wherein the high-voltage cable is connected to conductors which are held in resin busbar modules for connection with the general electrodes by fastening the crimp terminals to the conductors through tightening bolts or nuts and two ribs are formed on each of the busbar modules in positions where the crimp terminal is held therebetween so as to limit an entrained rotation of the crimp terminal when the bolt or nut is tightened, and wherein a gap between the two ribs on one of the adjacent battery packs is set so that a difference between the gap and a width of a straight-line portion of the crimp terminal which is connected to the general electrode of the one of the adjacent battery packs is set to a first gap dimension and a gap between the two ribs on the other of the adjacent battery packs is set so that a difference between the gap and a width of a straight-line portion of the crimp terminal which is connected to the general electrode of the other of the adjacent battery packs is set to a second gap dimension which is larger than the first gap dimension.

Firstly, in the high-voltage cable, on the crimp terminals at both the ends thereof, one of the crimp terminals is connected to the conductor by the bolt or nut, and the other of the crimp terminals is connected to the conductor of the other battery pack with the high-voltage cable curved. As this occurs, a restoring force is produced by the elastic deformation of the high-voltage cable (a covering portion) resulting from the high-voltage cable being curved to thereby be applied to the other crimp terminal. Therefore, when the other crimp terminal is connected to the conductor, the attaching work has to be carried out against the restoring force.

In this regards, in the invention, the second gap dimension defined between the ribs between which the other crimp terminal is accommodated is set larger than the first gap dimension defined between the ribs between which the one crimp terminal is accommodated. Consequently, the other crimp terminal can be accommodated between the ribs in such a state that the crimp is oriented between the ribs in a direction corresponding to the restoring force of the high-voltage cable, that is, a direction in which the restoring force of the high-voltage cable is released. Therefore, the easy performance of attaching work of the high-voltage cable can be improved by reducing the operation force of the high-voltage cable which is applied against the restoring force of the high-voltage cable. Additionally, the other crimp terminal which is accommodated between the ribs rotates about a rotational axis of the bolt or nut in the direction in which the restoring force of the high-voltage cable is released between the ribs. Because of this, even in the event that the high-voltage cable slackens largely, the slackness of the high-voltage cable can be absorbed by the rotation of the crimp terminal, thereby making it possible to mitigate the angle at which the high-voltage cable is curved. Therefore, it is possible to prevent the projecting curved portion of the high-voltage cable from coming into contact with other parts, thereby making it possible to prevent the occurrence of damage to the high-voltage cable or abnormal noise in association with vibrations of the high-voltage cable.

In the electric cable connecting construction according to the above, the second gap dimension may be set based on at least one of a sectional area defined in a direction which is at right angles to an axis of the high-voltage cable and an overall length dimension of the high-voltage cable.

Namely, since the restoring force of the high-voltage cable differs according to the cross-sectional area (thickness) or the length of the cable, by setting the second gap dimension as required based on the cross-sectional area or the length, the restoring force of the high-voltage cable can be weakened effectively, thereby making it possible to improve the easy performance of attaching work of the high-voltage cable.

According to another aspect of the embodiments of the present invention, there is provided an electric cable connecting method in which a plurality of battery packs each including a plurality of batteries connected to each other in series are disposed so as to be space apart from each other and general electrodes of the battery packs which lie adjacent are connected to each other by a high-voltage cable having crimp terminals at ends thereof, wherein the high-voltage cable is connected to conductors which are held in resin busbar modules for connection with the general electrodes by fastening the crimp terminals to the conductors through tightening bolts or nuts and two ribs are formed on each of the busbar modules in positions where the crimp terminal is held therebetween so as to limit an entrained rotation of the crimp terminal when the bolt or nut is tightened, wherein a gap between the two ribs on one of the adjacent battery packs is set so that a difference between the gap and a width of a straight-line portion of the crimp terminal which is connected to the general electrode of the one of the adjacent battery packs is set to a first gap dimension and a gap between the two ribs on the other of the adjacent battery packs is set so that a difference between the gap and a width of a straight-line portion of the crimp terminal which is connected to the general electrode of the other of the adjacent battery packs is set to a second gap dimension which is larger than the first gap dimension, wherein the crimp terminal of the high-voltage cable which is connected to the general electrode of the one of the adjacent battery packs is accommodated between the two ribs on one of the busbar modules, and one end of the crimp terminal is fastened by the bolt or nut, thereafter, the high-voltage cable being curved, and wherein then, the crimp terminal which is connected to the general electrode of the other of the adjacent battery packs is accommodated between the two ribs on the other of the busbar modules, and the general electrode is inserted through a mounting hole formed in the crimp terminal, the bolt or nut being tightened in such a state that the crimp terminal is rotated about an axis of the bolt or nut.

DETAILED DESCRIPTION OF EMBODIMENTS

Hereinafter, an embodiment of an electric wire connecting construction realized by applying the invention thereto will be described by reference to the drawings. The electric wire connecting construction of this embodiment is described as being applied to a power supply system which is mounted in an electric vehicle which is driven by a driving force of an electric motor or a hybrid vehicle which is driven by driving forces of both an engine and an electric motor to supply electric power to the electric motor.

In this embodiment, for the sake of easy understanding of the description thereof, the construction of a battery pack in which a plurality of batteries are connected in series will be described first, and thereafter, an electric wire connecting construction will be described in which two battery packs are connected to each other in series by a high-voltage cable.

Figure 1:
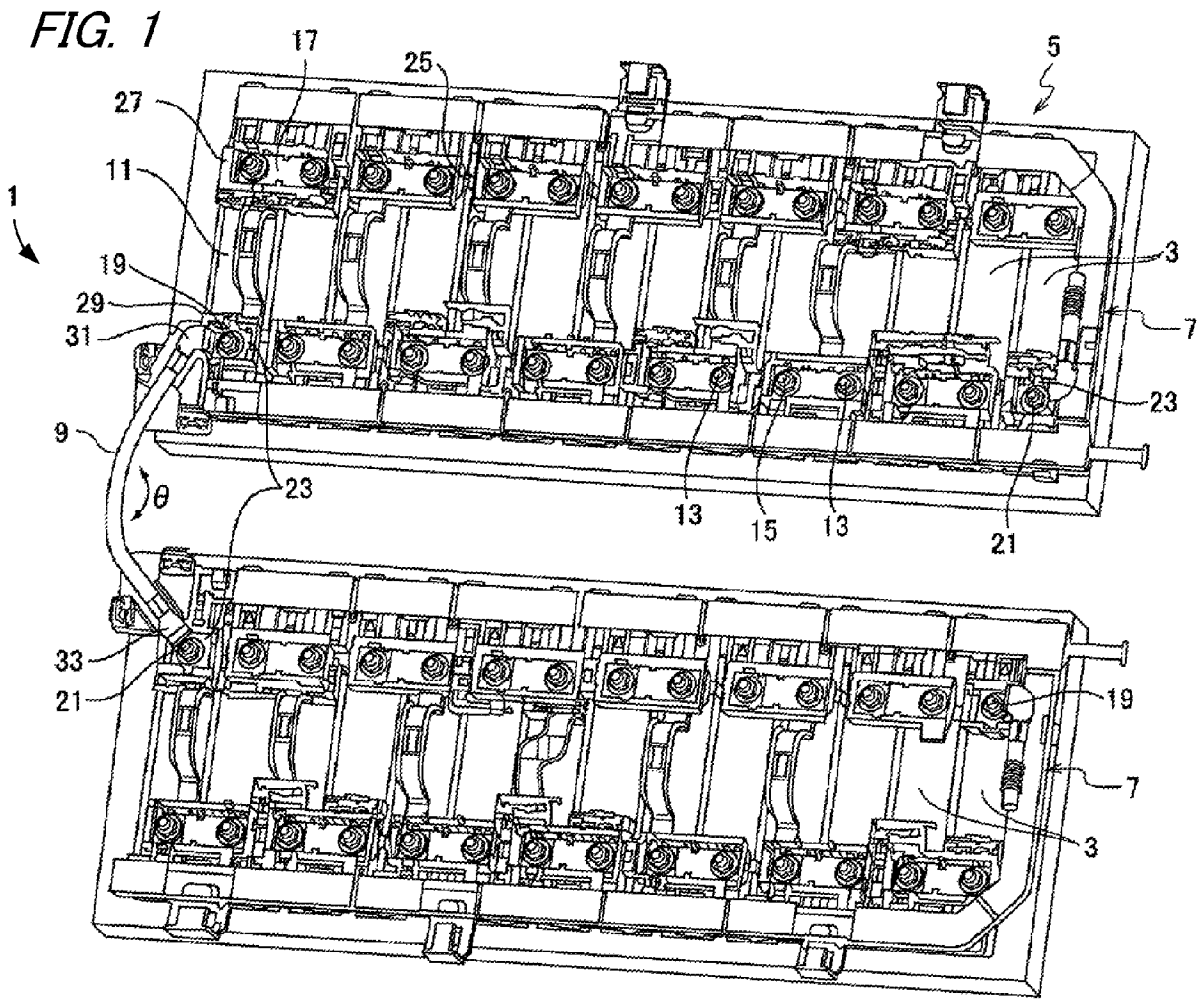
FIG. 1 is a perspective view depicting a state in which general electrodes of two battery packs are connected by a high-voltage cable by making use of an electric wire connecting construction to which the invention is applied.

As shown in FIG. 1, a battery system 1 includes two battery packs 5 each containing a plurality of batteries 3, a busbar module 7 which connects the batteries 3 in series and a high-voltage cable 9 which connects together general electrodes of the battery packs 5.

Each battery pack 5 includes the plurality of batteries 3 each having a rectangular parallelepiped shape which are accommodated in a frame member with electrode surfaces 11 aligned in the same direction. A cylindrical positive electrode 13 and a cylindrical negative electrode 15 are on the electrode surface 11 of each battery 3 so as to project therefrom. The batteries 3 are arranged so that the positive electrodes 13 and the negative electrodes 15 are aligned alternately on the adjacent batteries 3. In each battery pack 5, electrodes of the batteries 3 which are positioned at ends of the plurality of batteries 3 which are connected in series are made into general electrodes. For example, in the event that an even number of batteries 3 are connected in series, a positive electrode of the battery 3 at one end becomes a general positive electrode, while a negative electrode of the battery 3 at the other end becomes a general negative electrode. This embodiment will be described by taking for example a battery pack in which an even number (14) of batteries 3 are connected in series.

The busbar module 7 is a resin member which holds a plurality of first conductors 17 which connect together positive electrodes 13 and negative electrodes 15 of the adjacent batteries 3 in the battery pack 5 and two second conductors 23 which are connected to a general negative electrode 19 and a general positive electrode 21 of the batteries 3 which are disposed at both ends of the battery pack 5.

The first conductors 17 are individually fitted to be locked inside a plurality of first surrounding walls 27 which are connected to each other via a coupling portion 25. The second conductors 23 are individually fitted to be locked inside second surrounding walls 29 which are individually provided at both ends of the busbar module 7. A through hole is formed in the second conductor 23 through which the general positive electrode 19 or the general negative electrode 21 penetrates.

The busbar module 7 is formed as an integral unit including the coupling portions 25, the first surrounding walls 27 and the second surrounding walls 29 altogether. However, as viewed in FIG. 1, the busbar module 7 can be formed as being divided in a right half module and a left half module. In this embodiment, busbar modules 7 which are individually mounted in two battery packs 5 are formed generally symmetrically with each other.

Next, an electric wire connecting construction, which is a characteristic configuration of this embodiment, will be described.

Figure 2:
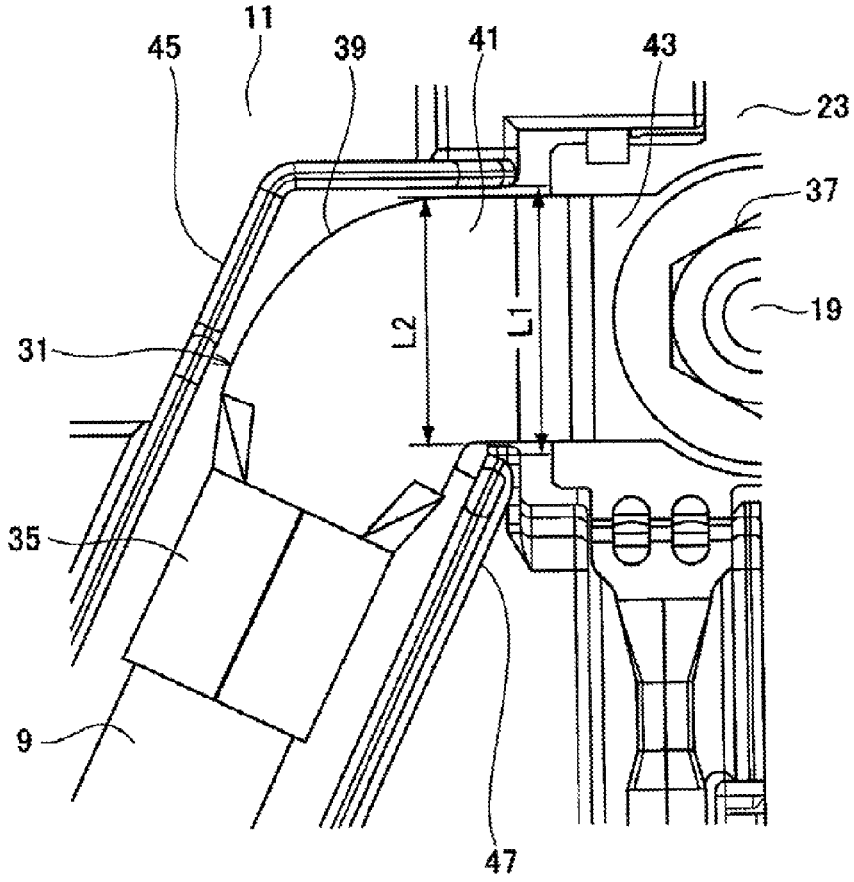
FIG. 2 is a diagram depicting a state in which a crimp terminal of the high-voltage cable is connected to the general electrode in the electric wire connecting construction depicted in FIG. 1.
Figure 3:
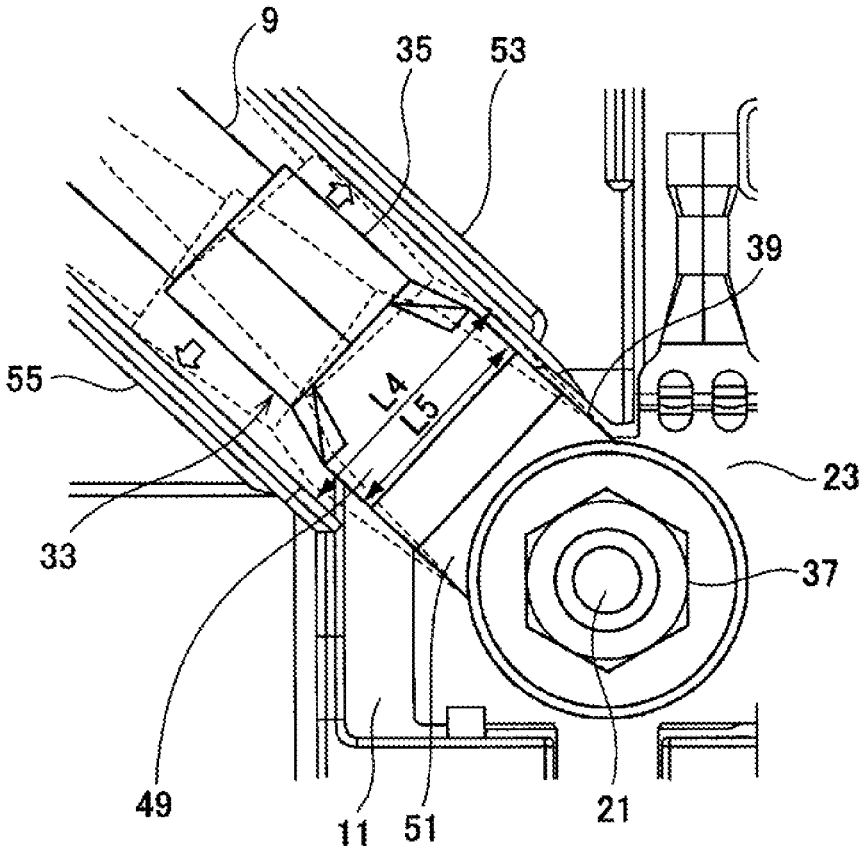
FIG. 3 is a diagram depicting a state in which a crimp terminal of the high voltage cable is connected to the general electrode in the electric wire connecting construction depicted in FIG. 1.

Crimp terminals 31, 33 are attached to both ends of a high-voltage cable 9. As shown in FIGS. 2 and 3, the crimp terminals 31,33 each have a crimping portion 35 which crimps a conductor portion exposed from the high-voltage cable 9 so as to encompass it therein and a mounting portion which is connected to the second conductor 23 with a nut 37.

A mounting hole (not shown) is formed in the mounting portion 39 so that the general electrode of the battery 3 is inserted therethrough.

Of the crimp terminals 31, 33, in the crimp terminal 31, the mounting portion 39 is curved at an obtuse angle in a longitudinal direction and is bent in a step-like fashion in a direction which is at right angles to the longitudinal direction (a front-to-rear direction in FIG. 2, hereinafter, referred to as a height direction). Namely, two planes 41, 43, which are different in height, are formed in the mounting portion 39. The plane 41 lying near the crimping portion 35 includes a portion which is curved at the obtuse angle in the longitudinal direction and portions which extends in a straight line from front and rear ends of the curved portion. On the other hand, the plane 43 lying far away from the crimping portion 35 has a mounting hole (not shown), which is formed in a circular end portion thereof so that the general positive electrode 19 of the battery 3 is inserted therethrough. The plane 43 where the mounting hole is formed is disposed at a lower level in height than the plane 41.

As will be described later, two ribs 45, 47 are formed on the busbar module 7 in positions where the crimp terminal 31 is held therebetween so as to restrict an entrained rotation of the crimp terminal 31 when the nut 37 is tightened on the crimp terminal 31. The crimping portion 35 and a portion corresponding to the plane 41 of the mounting portion 39 of the crimp terminal 31 are accommodated in an area which is defined by the ribs 45, 47.

Here, a dimension between the ribs 45, 47 is set so that a dimension of a gap defined between the crimp terminal 31 and the ribs 45, 47 becomes a first gap dimension. In this embodiment, as shown in FIG. 2, a difference between an inner dimension L1 between ends of the ribs 45, 47 which lie to face the general positive electrode 19 and a width L2 of the straight portion of the crimp terminal 31 (the mounting portion 39) which is accommodated inside the ribs 45, 47 is set as the first gap dimension L3. Then, this first gap dimension L3 is set, for example, to as small a size as possible which produces no problem in inserting the crimp terminal 31 between the ribs 45, 47.

In the other crimp terminal 33, as shown in FIG. 3, the crimping portion 35 and the mounting portion 39 are formed into a straight line, and the mounting portion 39 is bent in a step-like fashion in a direction which is at right angles to a longitudinal direction (a front-to-rear direction in FIG. 3, hereinafter, referred to as a height direction). Namely, two planes 49, 51, which are different in height, are formed in the mounting portion 39. A mounting hole (not shown) is formed in the plane 51 which lies far away from the crimping portion 35 so as to penetrate therethrough, so that the general negative electrode 21 of the battery 3 is inserted therethrough. The plane 51 where the mounting hole is formed is disposed at a lower level in height than the plane 49.

As will be described later, two ribs 53, 55 are formed on the busbar module 7 in positions where the crimp terminal 33 is held therebetween so as to restrict an entrained rotation of the crimp terminal 33 when the nut 37 is tightened on the crimp terminal 33. The crimping portion 35 and a portion corresponding to the plane 49 of the mounting portion 39 of the crimp terminal 33 are accommodated in an area which is defined by the ribs 53, 55.

Here, a dimension between the ribs 53, 55 is set so that a dimension of a gap defined between the crimp terminal 33 and the ribs 53, 55 becomes a second gap dimension. In this embodiment, as shown in FIG. 3, a difference between an inner dimension L4 between ends of the ribs 53, 55 which lie to face the general negative electrode 21 and a width L5 of the straight portion of the crimp terminal 33 (the mounting portion 39) which is accommodated inside the ribs 53, 55 is set as the second gap dimension L6. This second gap dimension L6 is set larger than the first gap dimension L3 and is set based, for example, on at least either of a cross sectional area of the high-voltage cable 9 in a direction which is at right angles to an axis thereof (a thickness of the cable) and a length of the high-voltage cable 9.

Next, a procedure of mounting the high-voltage cable 9 in the electric cable connecting construction which is configured in the way described above. It should be noted that the busbar module 7 is mounted in each of the two battery packs 5.

Firstly, as shown in FIG. 2, the crimp terminal 31 of the high-voltage cable 9 is disposed between the ribs 45, 47, and the general positive electrode 19 is inserted through the mounting hole in the mounting portion 39 of the crimp terminal 31. By doing this, the crimping portion 35 and an opposite side of the mounting portion 39 to the plane 41 are brought into abutment with a bottom surface of a portion of the busbar module 7 which lies between the ribs 45, 47. In this state, the nut 37 is screwed on the general positive electrode 19 which projects from the mounting hole and is then tightened in such a state that the mounting portion 39 of the crimp terminal 31 is in abutment with the second conductor 23. As this occurs, when the nut 37 is tightened, the crimp terminal 31 attempts to rotate in an entrained fashion together with the nut 37 in a direction in which the nut 37 is rotated. However, since the first gap dimension L3 is set to such a gap that only allows the crimp terminal 31 to be inserted between the ribs 45, 47, the crimp terminal 31 is held by the ribs 45, 47 therebetween, thereby eliminating a situation in which the crimp terminal 31 rotates in an entrained fashion together with the nut 37. Thus, by the nut 37 being so tightened, the second conductor 23, the crimp terminal 31 and the general positive electrode 19 are electrically connected together.

Next, the high-voltage cable 9 is curved so that the other crimp terminal 33 is disposed between the ribs 53, 55. Here, since the second gap dimension L6 is set larger than the first gap dimension L3, a widthwise dimensional allowance can be provided between the ribs 53, 55 to some extent in disposing the crimp terminal 33 between the ribs 53, 55. Because of this, since the high-voltage cable 9 is curved, that is, deformed elastically, the crimp terminal 33 is accommodated between the ribs 53, 55 in such a state that the crimp terminal 33 is oriented in a direction in which the restoring force of the elastic deformation is released. Consequently, the crimp terminal 33 is not disposed along a center line between the ribs 53, 55 but is disposed, for example, in such a state that the crimp terminal 33 is inclined from the center line at a predetermined angle in directions indicated by arrows in FIG. 3.

In this way, the crimp terminal 33 can be accommodated between the ribs 53, 55 in such a state that the crimp terminal 33 is oriented in the direction which corresponds to the restoring force of the high-voltage cable 9, that is, in the direction in which the restoring force of the high-voltage cable 9 is released between the ribs 53, 55. Therefore, the operating force of the high-voltage cable 9 which resists the restoring force thereof can be reduced, thereby making it possible to improve the easy performance of attaching work of the high-voltage cable 9.

In addition, the crimp terminal 33 rotates in the direction in which the restoring force of the high-voltage cable 9 is released about the general negative electrode which constitutes an rotational axis of the nut 37 in such a state that the crimp terminal 33 is temporarily fastened by the nut 37 (dotted lines in FIG. 3). Because of this, for example, even in the event that the high-voltage cable 9 slackens largely, the slackness of the high-voltage cable 9 can be absorbed by the rotation of the crimp terminal 33, thereby making it possible to mitigate an angle (θ in FIG. 1) at which the high-voltage cable 9 is curved. As a result, a curved and outwardly (towards a left hand side in FIG. 1) projecting portion moves in a direction in which the portion approaches the two battery packs 5 (towards a right hand side in FIG. 1), and therefore, it is possible to prevent the contact of the high-voltage cable 9 with other parts, thereby making it possible to prevent the occurrence of a damage to the high-voltage cable 9 or abnormal noise in association with vibrations of the high-voltage cable 9.

Thus, while the embodiment of the invention has been described in detail heretofore, the embodiment only illustrates the invention and hence, the invention is not limited only to the configuration of the embodiment. Even in the event that the invention is modified or altered in design without departing from the spirit and scope thereof, those modifications or alterations are, of course, included in the invention.

For example, in the electric cable connecting construction of the embodiment, while the crimp terminals 31, 33 are described as being fastened with the nuts 37, it is possible to adopt a configuration in which the crimp terminals 31, 33 are fastened with bolts, in place of the nuts 37. In addition, in the electric cable connecting construction of the embodiment, while the plurality of battery packs 5 are described as being connected in series by the high-voltage cable 9, the same cable connecting construction can also be applied to a case where general electrodes of the same polarity are connected in parallel.

The present application is based on Japanese patent application No. 2012-015292 filed on Jan. 27, 2012, and the contents of the patent application are incorporated herein by reference.

According to the invention, it is possible to improve the easy performance of attaching work of a high-voltage cable.

The invention claimed is:

1. An electric cable connecting construction in which a plurality of battery packs each including a plurality of batteries connected to each other in series are disposed so as to be space apart from each other and general electrodes of the battery packs which lie adjacent are connected to each other by a high-voltage cable having crimp terminals at ends thereof, wherein the high-voltage cable is connected to conductors which are held in resin busbar modules for connection with the general electrodes by fastening the crimp terminals to the conductors through tightening bolts or nuts and two ribs are formed on each of the busbar modules in positions where the crimp terminal is held therebetween so as to limit an entrained rotation of the crimp terminal when the bolt or nut is tightened, and wherein a gap between the two ribs on one of the adjacent battery packs is set so that a difference between the gap and a width of a straight-line portion of the crimp terminal which is connected to the general electrode of the one of the adjacent battery packs is set to a first gap dimension and a gap between the two ribs on the other of the adjacent battery packs is set so that a difference between the gap and a width of a straight-line portion of the crimp terminal which is connected to the general electrode of the other of the adjacent battery packs is set to a second gap dimension which is larger than the first gap dimension.

2. The electric cable connecting construction according to claim 1, wherein the second gap dimension is set based on at least one of a sectional area defined in a direction which is at right angles to an axis of the high-voltage cable and an overall length dimension of the high-voltage cable.

3. An electric cable connecting method in which a plurality of battery packs each including a plurality of batteries connected to each other in series are disposed so as to be space apart from each other and general electrodes of the battery packs which lie adjacent are connected to each other by a high-voltage cable having crimp terminals at ends thereof, wherein the high-voltage cable is connected to conductors which are held in resin busbar modules for connection with the general electrodes by fastening the crimp terminals to the conductors through tightening bolts or nuts and two ribs are formed on each of the busbar modules in positions where the crimp terminal is held therebetween so as to limit an entrained rotation of the crimp terminal when the bolt or nut is tightened, wherein a gap between the two ribs on one of the adjacent battery packs is set so that a difference between the gap and a width of a straight-line portion of the crimp terminal which is connected to the general electrode of the one of the adjacent battery packs is set to a first gap dimension and a gap between the two ribs on the other of the adjacent battery packs is set so that a difference between the gap and a width of a straight-line portion of the crimp terminal which is connected to the general electrode of the other of the adjacent battery packs is set to a second gap dimension which is larger than the first gap dimension, wherein the crimp terminal of the high-voltage cable which is connected to the general electrode of the one of the adjacent battery packs is accommodated between the two ribs on one of the busbar modules, and one end of the crimp terminal is fastened by the bolt or nut, thereafter, the high-voltage cable being curved, and wherein then, the crimp terminal which is connected to the general electrode of the other of the adjacent battery packs is accommodated between the two ribs on the other of the busbar modules, and the general electrode is inserted through a mounting hole formed in the crimp terminal, the bolt or nut being tightened in such a state that the crimp terminal is rotated about an axis of the bolt or nut.

* * * * *